US005961130A

United States Patent [19]

Gorza et al.

[11] Patent Number: 5,961,130

[45] Date of Patent: Oct. 5, 1999

[54] LOCKING DEVICE, PARTICULARLY FOR SKATE WHEELS

[75] Inventors: Roberto Gorza, Feltre; Alan Balzarotti, Treviso, both of Italy

[73] Assignee: Benetton Sportsystem S.p.A., Trevignano, Italy

[21] Appl. No.: 09/064,767

[22] Filed: Apr. 23, 1998

[30] Foreign Application Priority Data

May 9, 1997 [IT] Italy ..... TV97A0059

[51] Int. Cl.[6] ..... A63C 17/14

[52] U.S. Cl. ..... 280/11.2; 280/11.22

[58] Field of Search ..... 280/11.2, 11.22, 280/87.042; 188/1.12, 25, 19

[56] References Cited

U.S. PATENT DOCUMENTS 3,900,203 8/1975 Kukulowicz ..... 280/11.2
5,437,466 8/1995 Meibock et al. ..... 280/11.22
5,595,392 1/1997 Casillas ..... 280/7.13
5,755,449 5/1998 Pozzobon ..... 280/11.2
5,769,432 6/1998 Tybinkowski et al. ..... 280/11.2

*Primary Examiner*—Lanna Mai
*Assistant Examiner*—David R. Dunn
*Attorney, Agent, or Firm*—Guido Modiano; Albert Josif

[57] ABSTRACT

A locking device for skates constituted by a U-shaped frame for supporting a shoe, and including a first wing and a second wing between which two or more wheels are pivoted and arranged mutually in-line. An eccentric lever, arranged outside the first wing, is connected to a pusher which is slidingly associated with the first wing and with a pivot. The pivot is rigidly coupled to the second wing and is arranged in the interspace formed between two of the wheels which are mutually adjacent, the wheels interacting, during compression, with at least one elastically compressible element which is coaxial to the pusher.

16 Claims, 5 Drawing Sheets

LOCKING DEVICE, PARTICULARLY FOR SKATE WHEELS

BACKGROUND OF THE INVENTION

The present invention relates to a locking device particularly usable for wheels of skates of the type which comprises a supporting frame for a shoe, between the wings of which two or more mutually in-line wheels are freely pivoted.

A problem currently felt in conventional skates is substantially the fact that it is impossible for the user to simply walk unless he removes the skates.

As a partial solution to this problem, U.S. Pat. No. 2,725,238 discloses a skate having a first supporting plate for a shoe, below which two mutually parallel pairs of wheels are pivoted.

The skate has a screw engaging a brake constituted by a second plate which is interposed between the shoe supporting plate and the rolling surfaces of the two pairs of wheels. The screw actuates a vertical movement of the second plate and thus allows the plate to interact with the rolling surface of the wheels so as to limit their rotation.

The skate has the drawback that it is necessary to operate the screw, which has a head which can be gripped by the user, arranged below the second plate and therefore in a region which is difficult to access. Moreover, wheel locking occurs after intense pressure, which can be applied to the wheels by means of the second plate, therefore requiring application of a large number of turns to the screw, which takes a long time and is awkward because of the position of the screw.

U.S. Pat. No. 3,900,203 discloses a skate which has a shoe supporting frame provided with two wings which are mutually parallel and are directed towards the ground.

Two pairs of wheels are pivoted between the wings and are mutually connected in pairs by two auxiliary plates which have, in the interspace between two adjacent wheels, holes which also pass at the wings of the frame and accommodate the shank of a screw which is threaded at one end and is connected to a knob arranged externally to one of the wings of the frame.

A rotation applied to the knob forces the deformation of at least one of the two auxiliary plates, whose flexing makes the auxiliary plate interact with the surface of a disk associated with the hub of the wheels, thus obtaining a braking effect.

Also this solution is not ideal, since it is not easy for the user to turn the knob. Moreover, it is necessary to apply a considerable force to achieve the mutual locking of the two elements.

Moreover, this solution has shown less than perfect efficiency over time, owing to the wear of the materials placed in mutual contact, which are in any case subject to slight friction even when the user walks.

U.S. Pat. No. 4,312,514 discloses a skate which has a shoe supporting plate and below which two pairs of wheels, arranged parallel to each other, are freely pivoted.

In this solution it is possible to lock each one of the pairs of wheels, since on each one there are provided two rollers which are arranged transversely to the wheels and can be moved into contact with the rolling surface of the wheels by activating a suitable washer which is rotatably associated with a complementarily threaded shank which is coupled, at one end, to the pivot of the wheels and passes at the specifically provided seat formed in a roller connecting element.

Also this solution suffers the above-mentioned drawbacks and therefore entails difficulty in activating the washers arranged below the shoe supporting plate and the considerable time required to activate said washers; to make matters worse, there are two washers.

U.S. Pat. No. 5,503,433 discloses a skate which has a shoe supporting frame and comprises two mutually parallel lateral wings, between which four wheels are freely pivoted.

This solution uses, as an element for locking the rotation of the wheels, a cable which is closed in a loop and can be locked, at one end, at the interspace between the base of the frame and the first front wheel, while suitable cylinders are associated transversely to the cable and can be interposed in the gap between two mutually adjacent wheels. The last cylinder can be arranged at the end of the frame that lies above the rear wheel.

This solution, however, is scarcely safe in terms of user protection, because the force that can be applied by the rollers does not ensure perfect locking of the wheels. The locking action in fact cannot be adjusted in any way by the user to adapt it for example to his physical characteristics, such as his/her weight. Moreover, the cable must be carried by the user, must be stored and may be lost.

U.S. Pat. No. 5,511,805 discloses a skate which has a shoe supporting frame and comprises two lateral wings, between which wheels are freely pivoted and are thus arranged mutually in-line.

An auxiliary wheel truck is located between the lateral wings of the frame and is fixed to the lateral wings by means of an actuation screw which alters its position transversely to the frame.

Changing the position of the truck by means of the screw causes the auxiliary wheels, which lie in the interspace between two adjacent wheels, to interact with the latter wheels, thus locking their movement.

However, this solution too entails the above-mentioned drawbacks, since wheel locking is awkward and requires a long time to be performed owing to the need to turn the screw several times.

SUMMARY OF THE INVENTION

The aim of the present invention is to solve the above-mentioned problems, eliminating the drawbacks of the cited prior art, by providing a device which allows the user to lock the wheels of a skate quickly and easily.

An important object of the present invention is to provide a device whose actuation is immediately understandable to the user.

A further important object of the present invention is to provide a device which allows to achieve, once activated, optimum locking of wheel rotation.

A further important object of the present invention is to provide a device whose functionality is independent of the state of wear of the wheels.

A further object of the present invention is to provide a device which is structurally simple and can be easily positioned on the frame that constitutes the skate.

This aim, these objects and others which will become apparent hereinafter are achieved by a locking device, particularly for skates constituted by a U-shaped frame comprising a first wing and a second wing having at least two wheels pivoted thereto, characterized in that it comprises at least one traction-operated actuation element, which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher.

BRIEF DESCRIPTION OF THE DRAWINGS

Further characteristics and advantages of the locking device according to the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
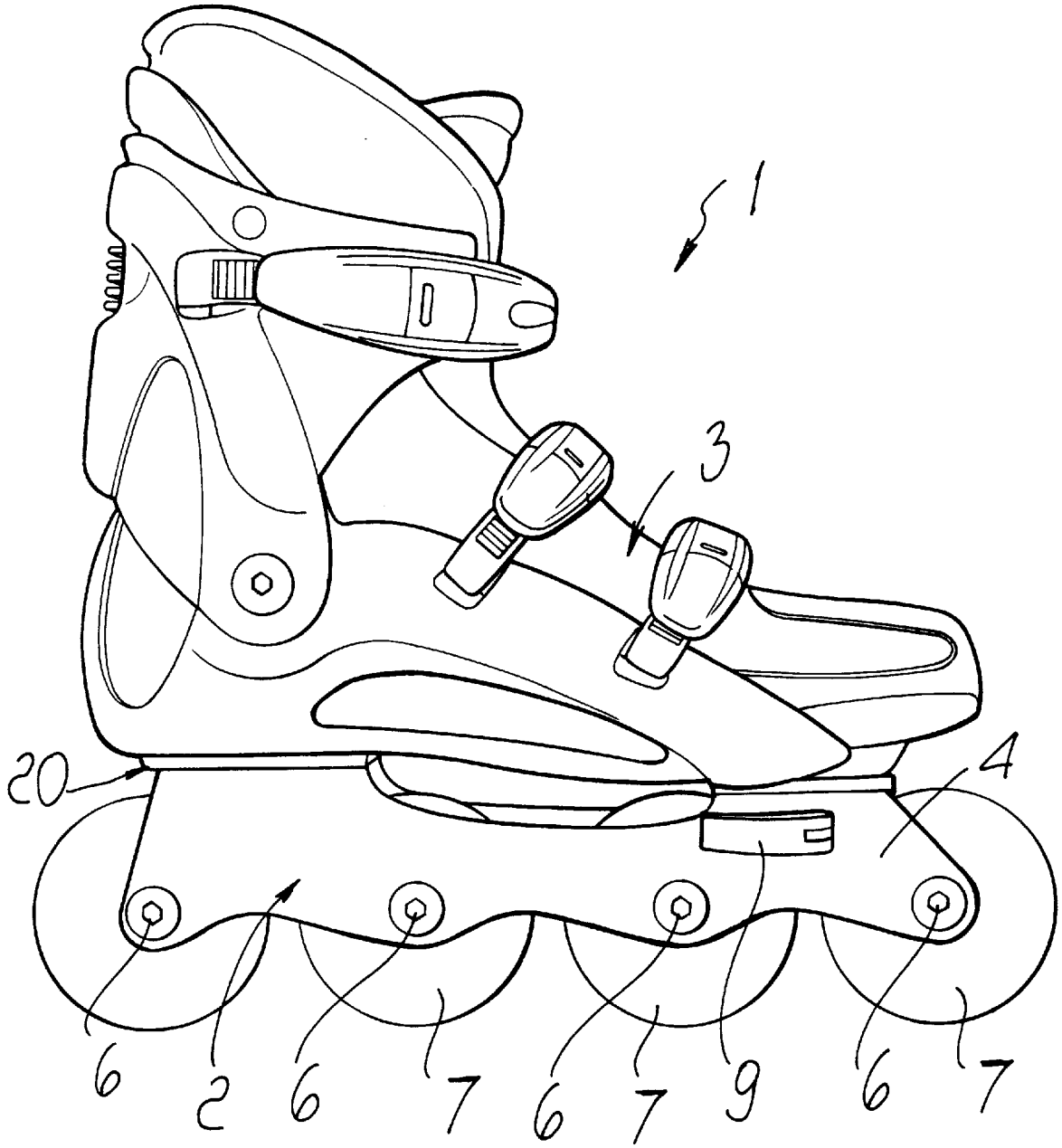
FIG. 1 is a side view of a skate with the device applied thereto.
Figure 2:
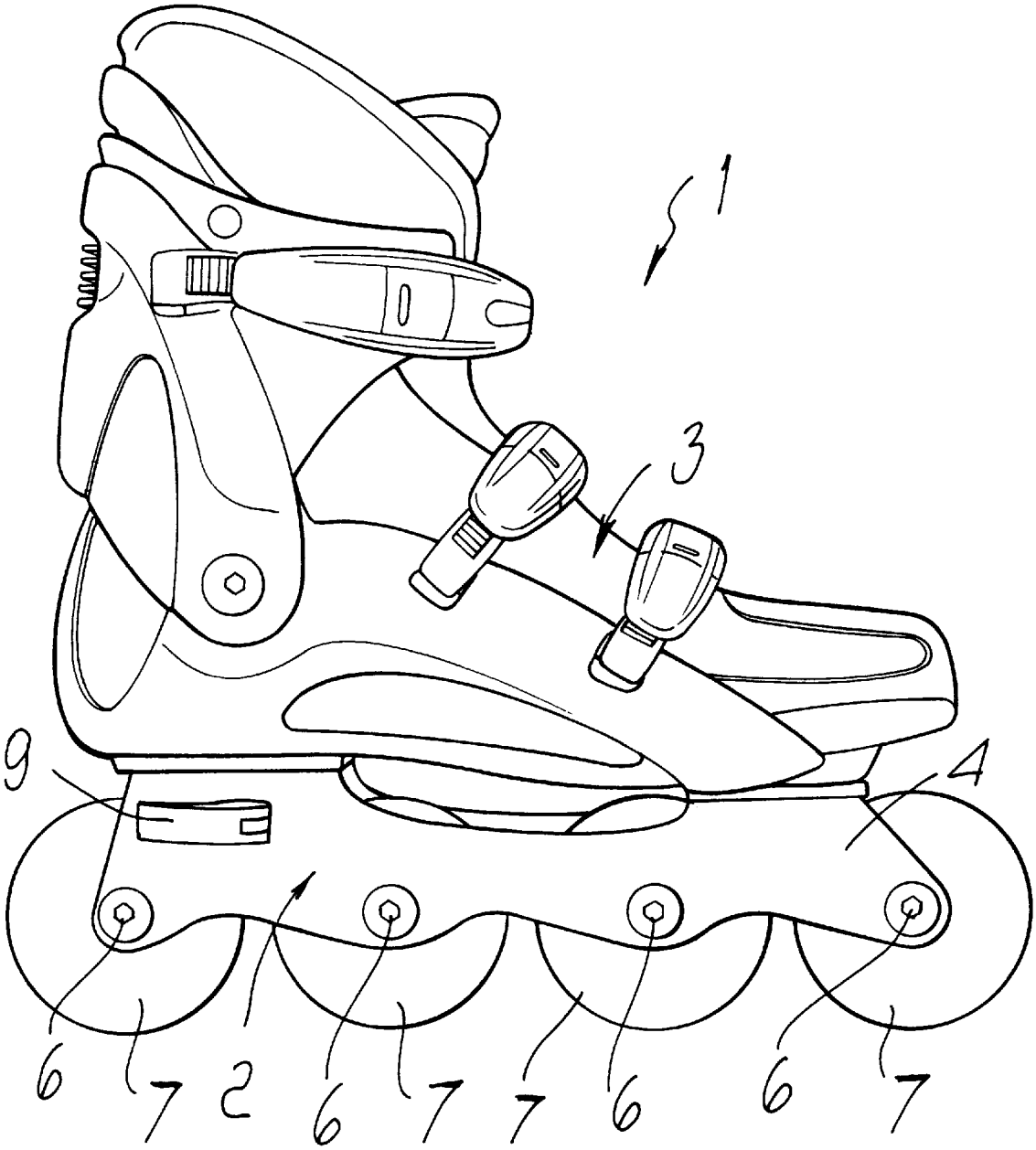
FIG. 2 is a view, similar to FIG. 1, of a skate with the device applied in a different place.
Figure 3:
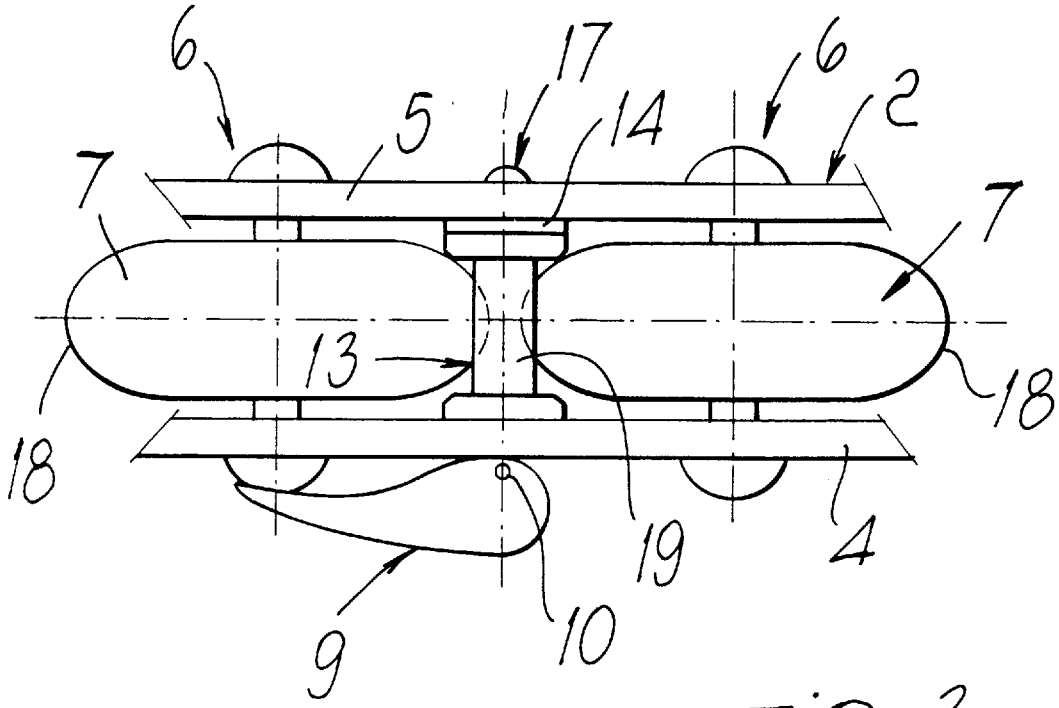
FIG. 3 is a bottom view of the skate in the condition in which the device is not activated.
Figure 4:
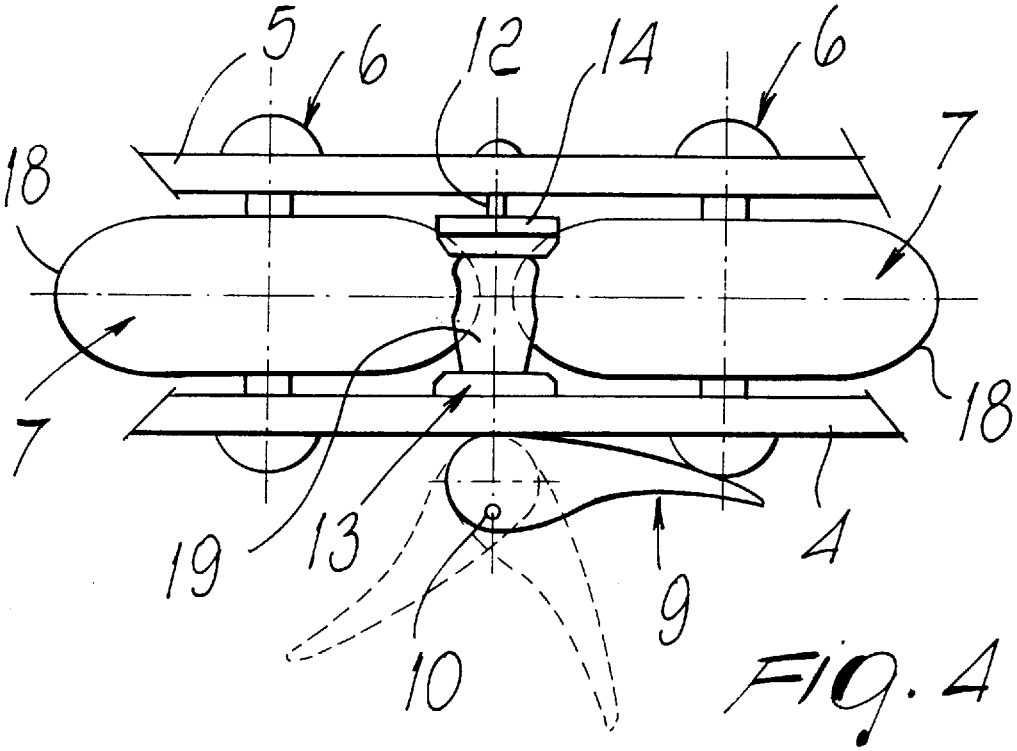
FIG. 4 is a view, similar to FIG. 3, of the condition in which the device is activated.
Figure 5:
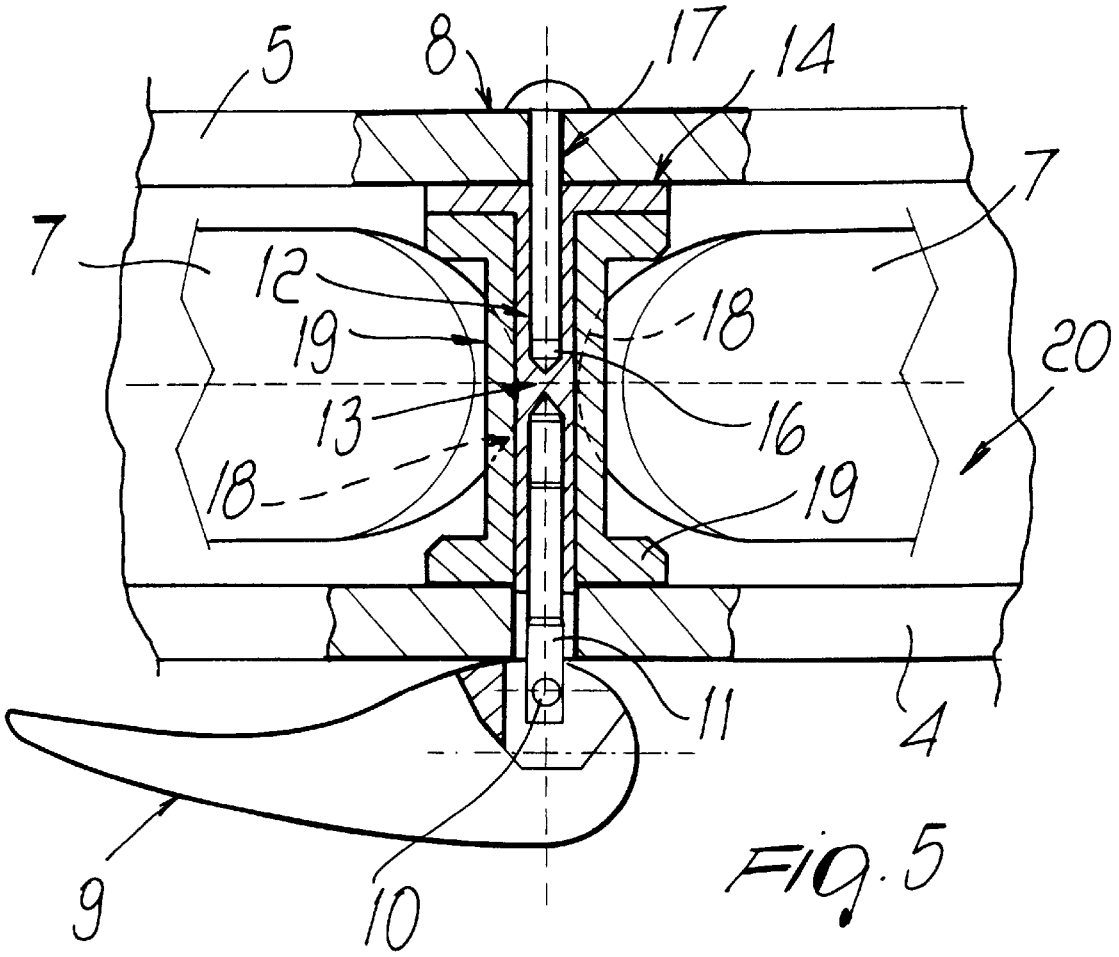
FIG. 5 is a sectional view of the embodiment of FIG. 3.

With reference to the above figures, the reference numeral 1 designates a skate which is constituted by a U-shaped frame 2 for supporting a shoe 3.

The frame 2 comprises a first wing 4 and a second wing 5, between which wheels 7 are pivoted by means of axles 6 and are thus arranged mutually in-line.

The locking device, generally designated by the reference numeral 8, is constituted by at least one traction-operated actuation element, such as an eccentric lever 9, which is arranged outside the first wing 4 and/or the second wing 5 in a chosen region of the frame 2.

In the illustrated embodiments, the eccentric lever 9 can be arranged in a front or rear region of the frame 2, in an intermediate point between two mutually adjacent wheels 7.

The eccentric lever 9 is associated, by means of a pin 10, with a pivot 11 which is externally threaded and interacts with a complementarily threaded seat formed axially to the shank 12 of a pusher 13.

Said pusher is substantially T-shaped; its head 14 is adjacent to the inner lateral surface of the second wing 5 and its shank 12 is slidingly associated at a suitable first seat formed on the first wing 4 of the frame 2.

The second pivot 11 affects only part of the height of the shank 12 of the pusher 13. A second seat 16 is provided on the same axis, starting from the head 14. The shank of a third pivot 17 is arranged in the second seat 16. The third pivot is associated with the second wing 5 and has the same axis as the pusher 13.

The rotation of the eccentric lever 9 thus allows to axially move the shank 12 of the pusher 13 so as to move its head 14 away from the second wing 5 and towards the first wing 4.

The second pivot 11 and the third pivot 17 are located in an intermediate region between two mutually adjacent wheels 7, preferably at an equal distance from the respective rolling surfaces 18.

The pusher 13 is also constituted by an elastically compressible element 19 arranged coaxially to the shank 12 of said pusher 13.

The elastically compressible element 19 is interposed between the head 14 of the pusher 13 that does not interact with the inner surface of the second wing 5 and the inner lateral surface of the first wing 4.

The elastically compressible element 19 preferably has a substantially H-shaped longitudinal cross-section.

Advantageously, the pusher 13 is arranged in a region which is adjacent to the base 20 of the frame 2 for connecting the first and second wings and therefore substantially in a region that lies above the plane of arrangement of the first pivots 6.

The operation of the device is the following: a rotation applied to the eccentric lever 9 is followed by an axial movement of the pusher 13 and thus by a spacing of its head 14 and of the wing 5.

In this manner, the head 14 compresses the elastically compressible element 19, which undergoes deformation and interacts with the rolling surfaces of the wheels 7 that are adjacent thereto.

The degree of interaction between the elastically compressible element and the wheels can be changed by screwing or unscrewing the second pivot 11 with respect to the shank 12 of the pusher 13, so as to allow the user to adjust it according to characteristics such as for example his/her weight or the degree of wear of the wheels.

It is apparent how the invention has achieved the intended aim and objects, a device having been provided which allows a user to quickly and easily achieve optimum locking of the wheels of a skate, the user being able to vary the force that can be applied to the wheels in order to lock them according to individual specific requirements, such as for example body weight or the degree of wear of the wheels.

Actuation of the device is self-evident, while the activated or deactivated condition of the device is immediately perceivable by the user.

The traction-operated actuation element constituted by the eccentric lever 9 can of course be replaced with other technically equivalent elements, such as for example a knob which interacts with a helical surface or a slider which interacts with an inclined plane, such as to produce the axial movement of the pusher 13 towards the wheels 7.

The invention is susceptible of numerous modifications and variations, all of which are within the scope of the same inventive concept.

Figure 6:
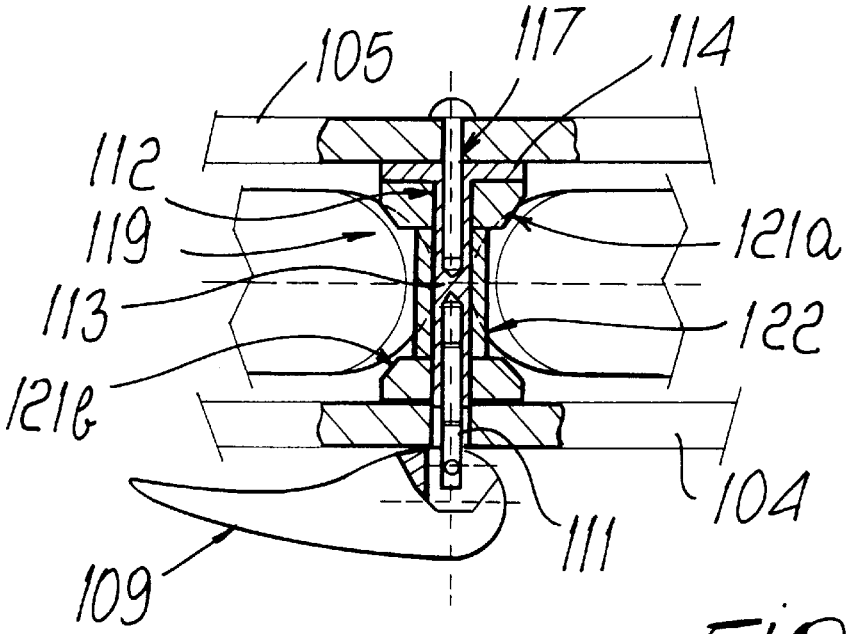
FIG. 6 is a view, similar to FIG. 5, of a different embodiment.

Thus, for example, FIG. 6 illustrates a device in which the elastically compressible element 119 is constituted by a pair of blocks 121*a* and 121*b* which are arranged coaxially to the shank 112 of the pusher 113 and have substantially the shape of a truncated cone.

The pair of blocks has a base which interacts respectively with the inner lateral surface of the first wing 104 of the frame and with the surface of the head 114 and of the pusher 113 that lies opposite to the one that faces the second wing 105 of the chassis.

A sleeve 122 is arranged between the pair of blocks 121*a* and 121*b*, is coaxial to the shank 112 of the pusher 113, and has a degree of elasticity which is equal to, or different from, that of the pair of blocks 121*a* and 121*b*; said blocks preferably have a lower degree of compressibility, so as to achieve better grip at the surfaces of the wheels that are adjacent to the rolling surface and also achieve lower wear over time.

The pusher 113 is again activated by means of a traction-operated actuation element, such as the eccentric lever 109, or by means of technically equivalent elements, which is connected to a second pivot 111 axially aligned with a third pivot 117 which is connected to the second wing 105, as the previous embodiment.

Figure 7:
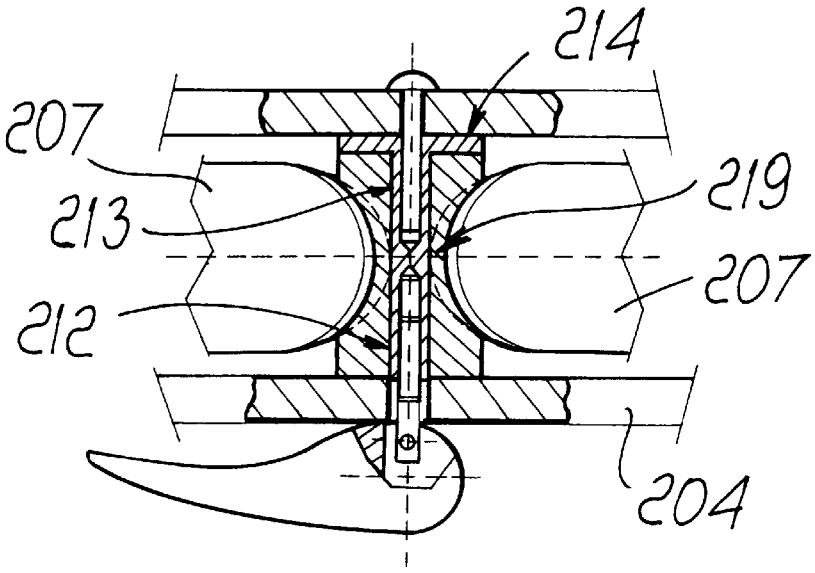
FIGS. 7 and 8 are views, similar to FIG. 5, of two further embodiments of the device.

FIG. 7 illustrates an embodiment in which the elastically compressible element 219, arranged coaxially to the shank 212 of the pusher 213 and interposed between the head 214 thereof and the inner lateral surface of the first wing 204 of the frame, has a lateral surface that is shaped approximately complementarily to the surfaces of the adjacent wheels 207; this allows to increase the contact surface between the elastically compressible element 219 and the wheels.

Figure 8:
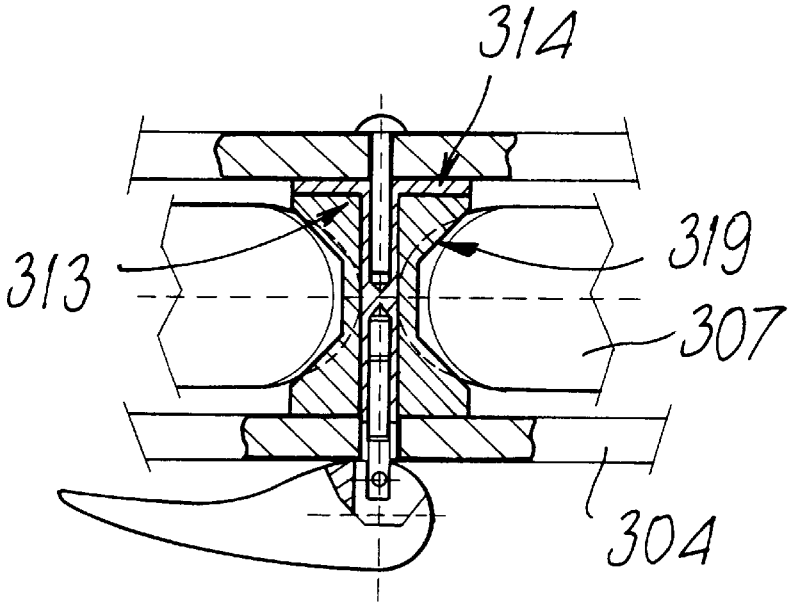

FIG. 8 illustrates a further embodiment for the elastically compressible element 319, which is interposed between the lateral surface of the first wing 304 and the head 314 of the pusher 313, has a lateral surface which is substantially V-shaped in a longitudinal cross-section, so as to again follow, albeit along a broken-line path, the shape of the adjacent wheels 307 and acting mainly at the surfaces thereof which are adjacent to the rolling surface.

The materials and the dimensions that constitute the individual components of the device may of course be the most pertinent according to specific requirements.

What is claimed is:

1. A locking device, particularly for skates constituted by a U-shaped frame comprising a first wing and a second wing having at least two wheels pivoted thereto, comprising at least one traction-operated actuation element which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher, said traction-operated actuation element being an eccentric lever associated, by means of a pin, with said pivot which is externally threaded and interacts with a complementarily threaded seat formed axially to a shank of said pusher, said pusher being substantially T-shaped and having a head arranged adjacent to the inner lateral surface of said second wing, the shank being slidingly associated at a suitable first seat formed on said first wing of said frame.

2. The device according to claim 1, wherein said pivot extends at only a part of a height of said shank of said pusher, a second seat being formed on the same axis starting from said head, the shank of a second pivot associated with said second wing being arranged in said second seat.

3. The device according to claim 2, wherein a rotation of said eccentric lever produces an axial movement of said shank of said pusher, moving said head away from said second wing.

4. The device according to claim 3, wherein said first and second pivots are located in an intermediate region between two of said mutually adjacent wheels, at an equal distance from respective rolling surfaces of said two of said mutually adjacent wheels.

5. The device according to claim 3, wherein said pusher is located in a region which is adjacent to a base of said frame for connecting said first and second wings in a region that lies above the plane of arrangement of said axles.

6. A locking device, particularly for skates constituted by a U-shaped frame comprising a first wing and a second wing having at least two wheels pivoted thereto, comprising at least one traction-operated actuation element which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher, said at least one elastically compressible element being arranged coaxially to a shank of said pusher and being interposed between the surface of said head that does not interact with the inner surface of said second wing and the inner lateral surface of said first wing said elastically compressible element being substantially H-shaped in a longitudinal cross-section.

7. A locking device, particularly for skates constituted by a U-shaped frame comprising a first wing and a second wing having at least two wheels pivoted thereto, comprising at least one traction-operated actuation element which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher, said at least one elastically compressible element being constituted by two blocks which are arranged coaxially to a shank of said pusher and having substantially the shape of a truncated cone, said pair of blocks having a base which interacts respectively with said inner lateral surface of said first wing of said frame and with the surface of said head of said pusher which is opposite to the one that faces said second wing of said frame.

8. The device according to claim 7, wherein a sleeve is arranged between said two blocks, said sleeve being coaxial to said shank of said pusher, said blocks having a lower degree of compressibility than said sleeve.

9. A locking device, particularly for skates constituted by a U-shaped frame comprising a first wing and a second wing having at least two wheels pivoted thereto, comprising at least one traction-operated actuation element which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher, said at least one elastically compressible element having a lateral surface which is shaped approximately complementarily to the adjacent surfaces of two of said wheels which are mutually adjacent.

10. A locking device, particularly for skates constituted by a U-shaped frame comprising a first wing and a second wing having at least two wheels pivoted thereto, comprising at least one traction-operated actuation element which lies outside said first wing and is connected to a pusher which is slidingly associated with said first wing and with a pivot, said pivot being rigidly coupled to said second wing and being arranged in the interspace formed between said at least two wheels which are mutually adjacent, said wheels interacting, during compression, with at least one elastically compressible element which is coaxial to said pusher, said at least one elastically compressible element having a lateral surface which is substantially V-shaped in a longitudinal cross-section, so as to follow, along a broken line, the shape of said adjacent wheels and act mainly at the surfaces thereof which are adjacent to the rolling surface.

11. A wheel locking device in a skate having a U-shaped frame comprising a first wing and a second wing and at least two wheels pivoted between said first and second wings at respective pivot axes, said locking device comprising:

a pivot element extending between said wings in a plane which lies between said pivot axes of said two wheels;

an elastically deformable brake element connected to said pivot element and arranged between outer peripheral surfaces of said two wheels, said brake element being arrangeable in a non-braking configuration in which said brake element is non-deformed elastically and arranged out of contact with said outer peripheral surfaces of said two wheels, and said brake element being arrangeable in a braking configuration in which said brake element is deformed elastically and arranged in contact with said outer peripheral surfaces of said two wheels; and a traction-operated actuation element arranged outside one of said wings and connected to said pivot element and operable to selectively position said brake element in said non-braking configuration and said braking configuration.

12. The combination of claim 11 further comprising a sliding shank arranged about said pivot element and provided with a head for selectively compressing said brake element into said braking configuration.

13. The combination of claim 12 comprising a hole in said one of said wings in which said sliding shank is slidingly arranged.

14. The combination of claim 13 wherein said pivot element comprises:

a first portion connected to said sliding shank and to which said traction-operated actuation element is connected; and a second portion connected to the other one of said wings and slidably supporting said sliding shank.

15. The combination of claim 14 wherein said traction-operated actuation element comprises an eccentric lever pivotally connected with said first portion of said pivot element and engaging an outer surface of said one of said wings.

16. The combination of claim 12 wherein said brake element is circumferentially arranged about said sliding shank and comprises a smaller diameter central cylindrical portion and at least one larger diameter end disk portion.

* * * * *